US006997025B2

(12) United States Patent
Friedman et al.

(10) Patent No.: US 6,997,025 B2
(45) Date of Patent: Feb. 14, 2006

(54) SEALING SYSTEM FOR SUPER-PLASTIC GAS-PRESSURE FORMING OF ALUMINUM SHEETS

(75) Inventors: Peter A. Friedman, Ann Arbor, MI (US); Warren Benjamin Copple, Trenton, MI (US); George Luckey, Jr., Dearborn, MI (US)

(73) Assignee: Ford Motor Company, Dearborn, MI (US)

( * ) Notice: Subject to any disclaimer, the term of this patent is extended or adjusted under 35 U.S.C. 154(b) by 368 days.

(21) Appl. No.: 10/248,978

(22) Filed: Mar. 6, 2003

(65) Prior Publication Data

US 2004/0172998 A1 Sep. 9, 2004

(51) Int. Cl.
*B21D 26/02* (2006.01)
*B21D 24/04* (2006.01)

(52) U.S. Cl. ..... 72/60; 72/350; 29/421.1

(58) Field of Classification Search ..... 72/56, 72/58, 60, 62, 63, 350; 29/421.1
See application file for complete search history.

(56) References Cited

U.S. PATENT DOCUMENTS

| | | | | | |
|---|---|---|---|---|---|
| 3,340,101 | A | | 9/1967 | Fields, Jr. et al. | |
| 3,934,441 | A | | 1/1976 | Hamilton et al. | |
| 4,331,284 | A | | 5/1982 | Schulz et al. | |
| 4,426,032 | A | | 1/1984 | Leodolter | |
| 4,603,808 | A | | 8/1986 | Stacher | |
| 5,035,133 | A | * | 7/1991 | White et al. | 72/350 |
| 5,157,969 | A | | 10/1992 | Roper | |
| 5,505,071 | A | * | 4/1996 | Hall, Jr. et al. | 72/350 |
| 5,603,449 | A | | 2/1997 | Mansbridge et al. | |
| 6,047,583 | A | * | 4/2000 | Schroth | 72/60 |
| 6,196,043 | B1 | * | 3/2001 | Ehardt | 72/350 |
| 6,745,604 | B1 | * | 6/2004 | Morales | 72/60 |

* cited by examiner

*Primary Examiner*—David Jones
(74) *Attorney, Agent, or Firm*—Raymond L. Coppiellie; Brooks & Kushman, P.C.

(57) ABSTRACT

A super-plastic forming tool for forming aluminum sheets is provided that includes a seal bead that is configured to facilitate removal of the aluminum sheet from the seal bead after a super-plastic forming operation. Contraction of the aluminum sheet at a faster rate than the super-plastic forming tool facilitates removal of the aluminum sheet due to the specific geometry of the seal bead. The seal bead has a more shallowly sloped outer surface than its inner surface and may be provided in different configurations including flat, convex, concave shapes.

18 Claims, 2 Drawing Sheets

SEALING SYSTEM FOR SUPER-PLASTIC GAS-PRESSURE FORMING OF ALUMINUM SHEETS

BACKGROUND OF INVENTION

1. Field of the Invention

The present invention relates to tooling for a super-plastic forming tool used to form heated aluminum sheets.

2. Background Art

Conventional sheet metal forming processes generally used to form steel metal panels for vehicles and other applications are not easily adapted to the forming of aluminum sheets. Aluminum sheet metal has reduced formability. Aluminum sheets, when formed in conventional sheet metal forming processes, suffer from insufficient ductility in the metal and spring back. In addition, tooling costs for aluminum sheet metal forming tools may be increased as the result of added steps taken to compensate for the reduced formability of the aluminum sheets.

One approach to forming aluminum sheets that shows promise is super-plastic gas-pressure forming. In a super-plastic gas-pressure forming process, a single sided concave tool is provided. The tool is heated and a blank is clamped to the die. The sheet metal blank, after being heated, is formed by the application of gas pressure and may also be formed by drawing a vacuum in the concave die. The aluminum sheet is formed to the contour of the female die. To successfully form with the super-plastic gas-pressure forming process, the cavity must be sealed so that pressure applied to one side of the blank is not dissipated. The seal is normally established by providing a seal bead on the tooling that engages the periphery of the aluminum sheet.

While various seal bead geometries have been developed, the geometry of seal beads that were previously used to obtain a satisfactory seal suffered from the drawback of causing aluminum sheets to stick to the die making removal of the formed part more difficult.

One example of an early method of thermoforming metal is disclosed in U.S. Pat. No. 3,340,101. In the '101 patent, the periphery of the metal sheet is clamped by a clamping ring that holds it in place during the thermoforming process.

In U.S. Pat. No. 6,347,583, a seal bead for super-plastic forming of aluminum sheets is disclosed. The seal bead shapes disclosed in the '583 patent provide a gas tight seal suitable for stretch forming. The seal bead shape disclosed in the '583 patent is stated to limit deformation of the sheet so that the sheet does not stick to the bead or to the tool during the forming process. The seal bead disclosed in the '583 patent provides a cusp cross-sectional shape that is machined into the binder surface for engaging the periphery of the sheet material. The cusp, as disclosed, is formed by the intersection of two arcs so that the bead penetrates the sheet to provide a gas tight seal but with minimal contact area. While the '583 patent recognized the problem, the solution proposed in the '583 patent required a complex die bead shape that results in increased manufacturing costs. In addition, the seal bead geometry disclosed in the '583 patent fails to take advantage of the difference in the thermal expansion characteristics between the die and sheet to facilitate removal of the sheet from the die.

The above problems are addressed by applicants' invention as summarized below.

SUMMARY OF INVENTION

Applicants' invention provides an improved, one-sided bead geometry applied to the binder of a super-plastic forming tool that establishes a seal during the super-plastic forming process and also allows the preferential shrinkage of an aluminum sheet relative to the forming die to facilitate removal of the sheet from the die after forming. This contraction difference with changes in temperature will occur with any die material that has lower thermal expansion properties (i.e., lower coefficient of thermal expansion) than aluminum, such as steel, cast iron or ceramic materials.

According to one aspect of the invention, a super-plastic forming tool for forming a heated sheet of aluminum alloy by applying gas pressure to a sheet clamped in a die is provided. The tool includes a first die having a peripheral portion having a sealing bead that engages the aluminum alloy sheet to form a seal. A second die has a peripheral portion that mates with the peripheral portion of the first die and includes a forming surface against which the aluminum alloy sheet is pressed. The sealing bead has an outer section and an inner section on opposite sides of a peak. The outer section of the sealing bead is wider than the inner section so that after forming, the sheet of aluminum alloy automatically strips itself from the first die because the aluminum sheet shrinks as it cools faster than the die, causing it to contract inwardly so that it separates itself from the bead.

According to another aspect of the invention, a method of super-plastic forming an aluminum alloy sheet is provided. According to the method, a super-plastic forming die is provided that has a forming surface and a two-part binder portion. A first part of the binder portion has a flat binder surface and the second part has a binder surface including a bead. The bead has an outer portion having a slope relative to the flat portion that is less than the slope of the inner portion relative to the flat portion. An aluminum sheet is placed into the super-plastic forming die so that the bead forms a seal when the two parts of the binder portion are pressed into engagement with the aluminum alloy sheet. The aluminum alloy sheet is heated in the super-plastic forming die. Gas under pressure is applied to the heated aluminum alloy sheet to form the sheet against the forming surface of the die. When the forming is completed, the pressure is released and the die is opened. The aluminum alloy sheet then shrinks as it cools faster than the super-plastic forming die so that the aluminum alloy sheet shifts inwardly as it contracts and separates itself from the sealing bead, thereby facilitating removal of the aluminum alloy sheet from the super-plastic forming die.

According to other aspects of the invention, the inner portion of the sealing bead may be perpendicular relative to the peripheral portion of the first die. The outer portion is an inclined plane protruding from the peripheral portion of the first die a first distance and extending a first width across the peripheral portion. The inner portion protrudes an equal distance from the peripheral portion of the first die as the first distance and extends a second width across the peripheral portion wherein the second width is less than the first width. The sealing bead may incorporate an inner portion that is an inclined plane, a convex surface, or a concave surface. The outer portion may comprise a convex surface or an inclined plane. The seal bead may have an asymmetrical cross section with an outer portion having a slope relative to the flat portion that is less than the slope of the inner portion relative to the flat portion.

These and other aspects of the present invention will be better understood in view of the attached drawings and following detailed description of several embodiments of the present invention.

DETAILED DESCRIPTION

Figure 1:
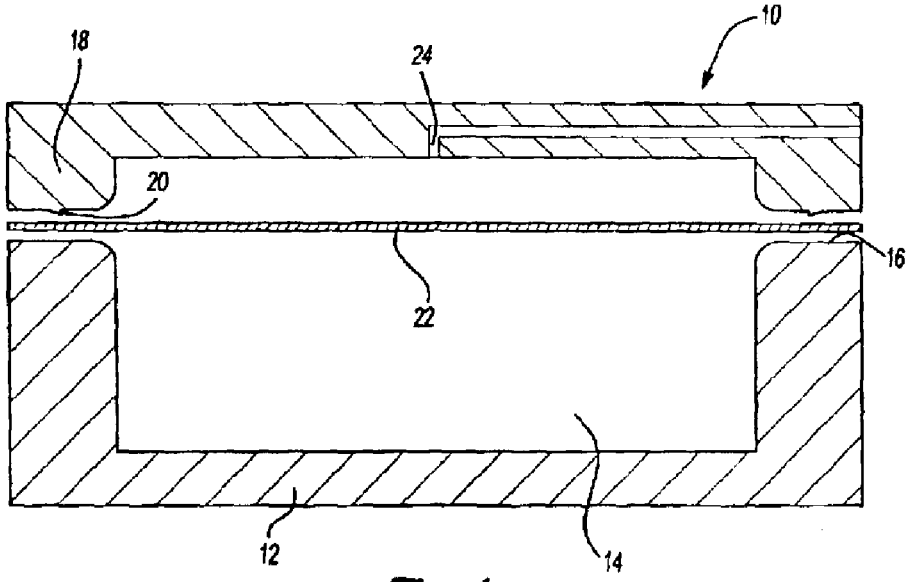
FIG. 1 is a schematic cross-sectional view of a super-plastic forming tool having a sheet of aluminum alloy loaded into the tool prior to the clamping and forming operations.

Referring now to FIG. 1, a super-plastic forming tool 10 (SPF) is illustrated schematically and includes a concave (female) die 12 that defines a forming region 14 for forming a part in the SPF tool 10. The concave die 12 has a flat peripheral surface 16 against which a binder ring 18 having a seal bead 20 clamps an aluminum sheet 22. The aluminum sheet 22 is heated and formed while in the SPF tool 10 by application of gas pressure on one side of the aluminum sheet 22. Gas pressure is supplied through a gas injection port 24. The seal bead 20 provides a seal when it engages the aluminum sheet 22 that prevents gas pressure from being dissipated from the SPF tool 10.

Figure 2:
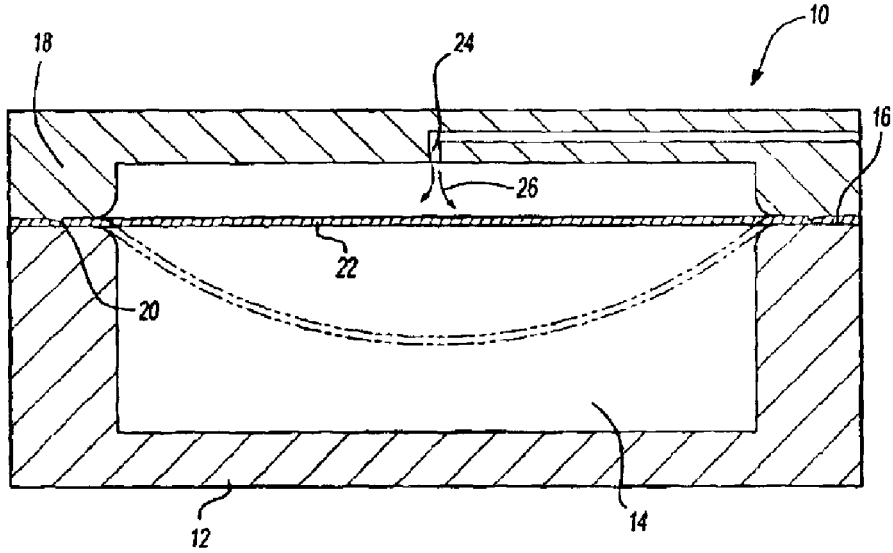
FIG. 2 is a schematic cross-sectional view of a super-plastic forming tool showing the aluminum sheet clamped in the tool and also showing in phantom deformation of the sheet in response to application of gas under pressure to the heated aluminum sheet.

Referring now to FIG. 2, the SPF tool 10 is shown with the binder ring 18 clamping the aluminum sheet 22 against he flat peripheral surface 16 of the concave die 12. Gas is supplied to the SPF tool 10 as indicated by arrows 26. The gas exerts a force on the heated aluminum sheet 22 causing the aluminum sheet to deflect as shown in phantom line. The seal bead 20 prevents the gas 26 from escaping along the upper surface of the aluminum sheet 22, as will be more fully described below.

Figure 3A:
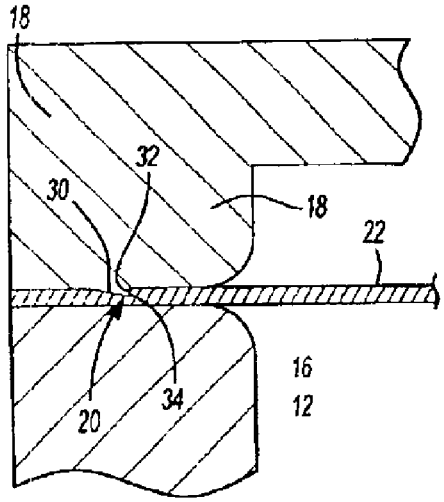
FIG. 3A is a fragmentary schematic cross-sectional view showing a super-plastic forming tool having a sealing bead made in accordance with one embodiment of the present invention engaging an aluminum sheet to form a seal therewith.

Referring now to FIG. 3A, the concave die 12 and binder ring 18 are shown fragmentarily and enlarged while engaging aluminum sheet 22. The seal bead 20 includes an inclined ramp outer surface 30 and a perpendicular inner surface 32 that together define a sharp edge 34. The seal bead 20 forms an indentation 36 in the aluminum sheet 22 when the binder ring 18 clamps the aluminum sheet against the flat peripheral surface 16 of the concave die 12.

Figure 3B:
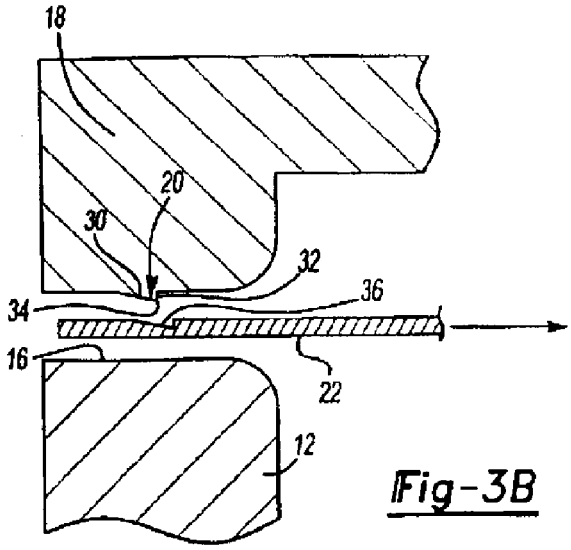
FIG. 3B is a fragmentary schematic cross-sectional view showing the aluminum sheet after forming as it strips itself from the sealing bead due to the contraction of the aluminum sheet.

Referring now to FIG. 3B, in a view similar to FIG. 3A, the aluminum sheet is shown being automatically released from the seal bead 20 after forming. The aluminum sheet 22 shrinks more rapidly than the binder ring 18 during cooling. When the aluminum sheet 22 contracts, the indentation 36 slides inwardly and off of the inclined plane ramp outer surface 30 allowing it to be easily separated from binder ring 18.

Figure 4A:
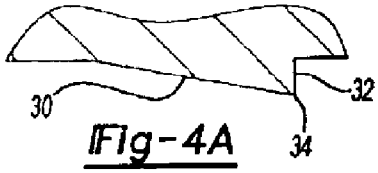
FIGS. 4A–4H show alternative embodiments of the sealing bead shape made in accordance with the present invention.

Other seal bead configurations may be provided that would provide the same self-releasing function. Referring to FIG. 4A, the seal bead has the same configuration as the seal bead 20 shown in FIGS. 1 through 3B but is shown enlarged and in isolation so that the relationship of the inclined ramp outer surface 30, perpendicular inner surface 32, and sharp edge 34 are more clearly illustrated.

Figure 4E:
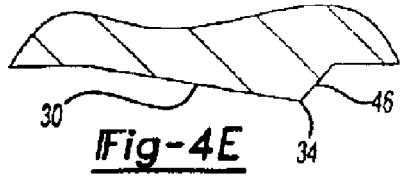
Figure 4B:
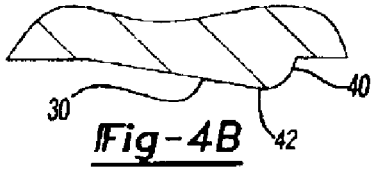

Referring now to FIG. 4B, another embodiment of the seal bead 20 is shown to include a convex inner surface 40 that defines with an inclined plane outer surface 30 a rounded edge 42.

Figure 4F:
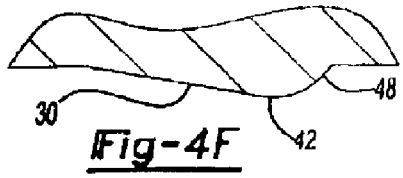
Figure 4C:
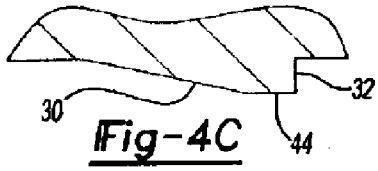

Referring now to FIG. 4C, another embodiment of the seal bead 20 is shown to include a flat land edge 44 that is provided between the inclined plane outer surface 30 and the perpendicular inner surface 32.

Figure 4G:
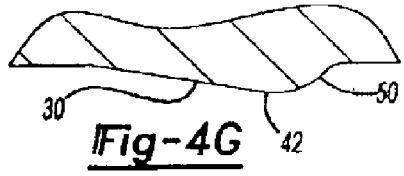
Figure 4D:
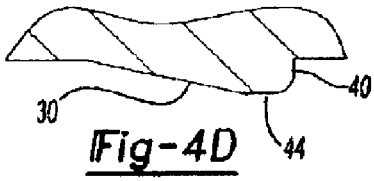

Referring now to FIG. 4D, another seal bead 20 is shown to include a flat land surface 44 between a inclined plane outer surface 30 and convex inner surface 40.

Referring now to FIG. 4E, a seal bead 20 is provided that includes a sharply inclined inner surface 46 and an inclined plane ramp outer surface 30 that together define a sharp edge 34.

Referring now to FIG. 4F, a reduced radius convex inner surface is provided in conjunction with an inclined plane outer surface 30 to form a rounded edge 42.

Referring now to FIG. 4G, a compound curve inner radius 50 is provided that defines a rounded edge 42 in conjunction with an inclined plane outer surface 30.

Figure 4H:
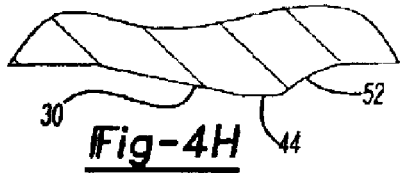

Referring now to FIG. 4H, a concave inner surface 52 is provided. The outer surface is an inclined plane outer surface 30 with a flat land edge 44 being provided between the outer surface 30 and concave inner surface 52.

While the best mode for carrying out the invention has been described in detail, those familiar with the art to which this invention relates will recognize various alternative designs and embodiments for practicing the invention as defined by the following claims.

What is claimed is:

1. A super-plastic forming tool for forming a heated sheet of metal having a first rate of thermal expansion by applying gas pressure to the sheet in a die having a second rate of thermal expansion that is less than the first rate, comprising:

a first die having a peripheral portion that engages the aluminum alloy sheet;

a second die having a peripheral portion that mates with the peripheral portion of the first die, the second die having a forming surface against which the aluminum alloy sheet is pressed; and a sealing bead formed on the peripheral portion of the first die;

a peak formed on the sealing bead that is defined as the portion of the sealing bead that extends away from the peripheral portion of the first die to the greatest extent;

an inner section of the sealing bead being defined as the portion of the sealing bead that is inboard of the peak;

an outer section of the sealing bead being defined as the portion of the sealing bead that is outboard of the peak, the outer section is wider than the inner section as measured from the peak; and wherein the heated sheet of metal shrinks more rapidly as it cools than the first die to thereby facilitate separating the sheet of metal from the first die.

2. The tool of claim 1 wherein the inner section of the sealing bead is perpendicular relative to the peripheral portion of the first die.

3. The tool of claim 1 wherein the outer section of the bead is an inclined plane extending outboard from the peak of the bead on the peripheral portion of the first die a first width across the peripheral portion as measured from the peak, the inner section extending inboard from the peak of the bead on the peripheral portion of the first die a second width across the peripheral portion as measured from the peak, wherein the second width is less than the first width.

4. The tool of claim 1 wherein the inner section is an inclined plane.

5. The tool of claim 1 wherein the inner section is a convex surface.

6. The tool of claim 1 wherein the inner section is a concave surface.

7. The tool of claim 1 wherein the outer section is a convex surface.

8. A forming tool for an aluminum sheet, said tool comprising a forming surface for forming the sheet and a binder surface that extends about the periphery of the forming surface, the binder surface forming a seal with the sheet, the binder surface having a flat portion and a seal bead having an asymmetrical cross section that defines an edge that extends from the binder surface to the maximum extent, the seal bead having an outer section that extends from the edge and away from the forming surface, an inner section of the seal bead that extends from the edge and toward the forming surface, wherein the outer section is disposed at an angle relative to the flat portion that is less than the angle of an inner section relative to the flat portion.

9. The tool of claim 8 wherein the inner section of the sealing bead is perpendicular relative to the binder surface of the first die.

10. The tool of claim 8 wherein the outer section is an inclined plane that extends from the binder surface of the first die a first distance and extending a first width across the binder surface and away from the forming surface, the inner section that extends an equal distance from the binder surface of the first die as the first distance and extending a second width across the binder surface and toward the forming surface, the second width being less than the first width.

11. The tool of claim 8 wherein the inner section is an inclined plane.

12. The tool of claim 8 wherein the inner section is a convex surface.

13. The tool of claim 8 wherein the inner section is a concave surface.

14. The tool of claim 8 wherein the outer section is a convex surface.

15. A method of super-plastic forming an alloy sheet having a first rate of thermal expansion, comprising:

providing a super-plastic forming die having a second, lower rate of thermal expansion and having a forming surface and a two part binder portion, wherein a first part of the binder portion has a flat binder surface and the second part has a binder surface with a bead, the bead having an outer portion that extends outwardly from the forming surface and being disposed at an angle relative to the flat portion, the bead having an inner portion that extends inwardly toward the forming surface and being disposed at an angle relative to the flat portion that is greater than the angle of the outer portion relative to the flat portion;

placing the alloy sheet into the super-plastic forming die with the bead forming a seal when the two parts of the binder portion are pressed into engagement with the alloy sheet;

heating the alloy sheet in the super-plastic forming die;

applying gas under pressure to the alloy sheet to form the sheet against the forming surface; and the alloy sheet shrinking faster than the super-plastic forming die during cooling so that the alloy sheet contracts and separates from the bead thereby facilitating removal of the alloy sheet from the super-plastic forming die.

16. The method of claim 15 wherein the alloy sheet is an aluminum alloy sheet.

17. The method of claim 15 wherein the super-plastic forming die is made from a material selected from the group consisting essentially of cast iron, steel, or ceramic.

18. The method of claim 15 wherein the alloy sheet is a magnesium alloy sheet.

* * * * *